US011358769B2

(12) United States Patent
Cerveny et al.

(10) Patent No.: US 11,358,769 B2
(45) Date of Patent: Jun. 14, 2022

(54) COMPOSITE PACKAGE

(71) Applicant: NESTEC S.A., Vevey (CH)

(72) Inventors: Jean-Paul Cerveny, Vittel (FR); Ben Xie, Fujian (CN)

(73) Assignee: Societe des Produits Nestle S.A., Vevey (CH)

( * ) Notice: Subject to any disclaimer, the term of this patent is extended or adjusted under 35 U.S.C. 154(b) by 319 days.

(21) Appl. No.: 15/537,464

(22) PCT Filed: Dec. 10, 2015

(86) PCT No.: PCT/EP2015/079323

§ 371 (c)(1),
(2) Date: Jun. 19, 2017

(87) PCT Pub. No.: WO2016/096619

PCT Pub. Date: Jun. 23, 2016

(65) Prior Publication Data

US 2017/0355498 A1 Dec. 14, 2017

(30) Foreign Application Priority Data

Dec. 18, 2014 (EP) ..... 14198928

(51) Int. Cl.
*B65D 71/10* (2006.01)
*B65D 85/72* (2006.01)

(52) U.S. Cl.
CPC ..... *B65D 71/10* (2013.01); *B65D 85/72* (2013.01); *B65D 2571/00493* (2013.01)

(58) Field of Classification Search
CPC ..... B65D 71/10; B65D 85/72; B65D 2571/00493
USPC ..... 206/427, 432, 497
See application file for complete search history.

(56) References Cited

U.S. PATENT DOCUMENTS

| | | | | |
|---|---|---|---|---|
| 3,387,702 | A * | 6/1968 | Reynolds | B65D 71/10 206/162 |
| 3,411,619 | A | 11/1968 | Saito et al. | |
| 4,256,223 | A | 3/1981 | Pawlowski | |
| 5,857,570 | A | 1/1999 | Brown | |
| 7,832,554 | B2 * | 11/2010 | Sutton-Rainey | B65D 71/16 206/162 |
| 9,022,253 | B2 * | 5/2015 | Oster | B65D 71/0018 220/318 |
| 2008/0230420 | A1 * | 9/2008 | Cerveny | B65D 71/10 206/432 |
| 2016/0152391 | A1 * | 6/2016 | Ramsuer | B65D 71/10 206/432 |

FOREIGN PATENT DOCUMENTS

| | | |
|---|---|---|
| EP | 2402263 | 1/2012 |

* cited by examiner

*Primary Examiner* — Anthony D Stashick
*Assistant Examiner* — James M Van Buskirk
(74) *Attorney, Agent, or Firm* — K&L Gates LLP

(57) ABSTRACT

A composite package (100) comprises a plurality of primary packages (102) which are gathered into at least one secondary package (106) that comprises an envelope (104) about at least some of said primary packages (102), and a handle (108), and is characterized in that the handle (108) is mobile between a retracted first position substantially enclosed within said composite package (100), and an extracted second position projecting at least partially from said composite package (100).

12 Claims, 6 Drawing Sheets

Section A-A

COMPOSITE PACKAGE

CROSS REFERENCE TO RELATED APPLICATIONS

The present application is a National Stage of International Application No. PCT/EP2015/079323, filed on Dec. 10, 2015, which claims priority to European Patent Application No. 14198928.5, filed on Dec. 18, 2014, the entire contents of which are being incorporated herein by reference.

FIELD OF THE INVENTION

The present invention concerns a composite package comprising a plurality of primary packages.

BACKGROUND OF THE INVENTION

It is well known to provide a number of different consumer products in the form of multiple-container packages, or "composite packages", wherein a quantity of individual containers are bundled together within an exterior packaging to form a single bundled package.

The individual containers are generally of an enclosed or sealed type so as to maintain the quality of the product within, while the exterior packaging is configured to hold the individual containers together during storage and transport yet be easily opened.

Such composite packages have been employed in many industries but are particularly well-known in the food and beverage domain, where it is often desirable to purchase large quantities of certain products at once, but where the use of a single large container is disfavoured because of product degradation or spoilage after opening.

These composite packages are advantageous in that they are generally easier to purchase, transport, and store than an equivalent amount of product in bulk or packaged in individual containers.

Since a large number of containers are bundled together into one package, the resulting package may be quite bulky and difficult to transport; thus, it is known to provide means such as handles for facilitating the manipulation and transport of the composite package.

In most instances currently known, this simply meant gluing a simple handle to the exterior of the composite package in the form of a paper or plastic strap. While easily manipulated by the consumer, such handles are disadvantageous in that, being disposed on the exterior of the composite package, they can easily be torn from the composite package or otherwise damaged prior to purchase, e.g. during transport, warehousing, or in-store display.

The document EP 1 849 714 A1 attempts to resolve this. In this document, there is provided a composite package wherein a number of bottles are arranged on a base, and a wrapper which at least partially encloses said bottles and base. The wrapper is a plastic shrink-film, and comprises a reinforced band delineated by two perforated lines.

The user must open the package by breaking the perforated bands and rotating the bottles away from it in two bundles, at which point he may grasp the handle and lift the package. In this way, the handle is provided embedded in the composite package until it reaches the purchaser, minimizing the possibility that the handle is damaged during shipment or storage of the composite package.

However, the composite package disclosed in EP 1 849 714 A1 requires the user to break the perforated bands and rotate the containers so that the handle may be extracted. These manipulations may be considered as drawbacks.

Specifically, once the perforations are broken, the user is presented with two "bunches" of bottles which must be rotated to permit the handle to be grasped and the composite package to be lifted. This may present a considerable amount of difficulty, particularly where the composite package is disposed where manipulation of the containers may be difficult, e.g. on a store shelf.

There is thus a need to provide a composite package which resolves at least some of the inconveniences present in the composite packages present in the prior art.

SUMMARY OF THE INVENTION

Accordingly, there is provided a composite package comprising a plurality of primary packages, said plurality of primary packages being gathered into at least one secondary package comprising an envelope surrounding at least some of said plurality of primary packages, and a handle for manipulating said at least one secondary package.

According to the invention, said handle is mobile between a retracted first position wherein said handle is two or more of said primary packages, and an extracted second position wherein said handle projects at least partially from one secondary package.

This is advantageous in that when the handle is disposed in the retracted first position it will be protected, by the primary packages within the composite pack, from damage and inadvertent extraction. This reduces the likelihood of any inadvertent damage to the handle, such as might otherwise occur during transport, warehouse storage, or display on store shelves.

This is also advantageous in that, in contrast to the prior art, the handle is extracted without requiring the user to move, displace, or otherwise touch the secondary packages; the user need only grasp the handle and pull to bring it into the extracted second position.

Preferably, the handle is disposed within the envelope of a secondary package when in the retracted first position, and wherein said envelope is perforated so as to at least partially delimit a region of said envelope coincident with said handle.

This is advantageous in that the handle is further protected from inadvertent damage or extraction, while maintaining a high level of ease of use; the user need only break the envelope over the perforated region to expose the handle and permit its extraction.

Preferably, the composite package comprises a single secondary package.

This is advantageous in that, when the primary packages are bound into a single secondary package, the resulting composite package will be stronger and more easily manipulated than an assemblage of secondary packages.

In a possible embodiment, the handle comprises a grip portion; two flexible portions each extending from an extremity of said grip portion; and two anchor portions each extending from an extremity of a flexible portion opposite said grip portion and embedded within said composite package, such that when said handle is in the retracted first position, said flexible portions are folded to form a recess within the secondary package in which said grip portion is substantially enclosed.

This is advantageous in that the folding of the flexible portion of the handle will minimize the amount of space within the composite package that is taken up by the handle when in the retracted first position. Such an embodiment is thereby given a high degree of flexibility, in that it is compatible with primary packages configured many different sizes and shapes.

In addition, the folded handle will have a negligible effect on the overall shape of the composite package, facilitating the grouping, stacking, and storage of a large quantity of such composite packages, such as on a shelf or pallet.

Preferably, the recess extends between two of the primary packages.

This is advantageous in that the overall size of the composite package is minimized.

Preferably, the handle is at least partially constituted by a sheet of cardboard.

This is advantageous in that a handle so configured is quickly and easily fabricated and at a minimal cost, while minimizing the weight that is added to the composite package by its inclusion.

Preferably, the grip portion comprises a lamination of at least two thicknesses of said sheet of cardboard.

A handle so configured will have increased strength and resistance at the location of the lamination, without greatly increasing the complexity of construction or manufacture of the handle.

Preferably, the handle is at least partially reinforced by a reinforcement comprising a band or film laminated with said sheet of cardboard, or a coating or impregnant applied to said sheet of cardboard.

Such reinforcement is advantageous in that it further increases the strength and resistance of the handle, permitting the use of a smaller handle than might otherwise be possible with an un-reinforced cardboard sheet.

Furthermore, the reinforcement may also serve to provide the handle particular qualities that may not be achieved by a bare cardboard sheet, increasing the range of applications in which such a handle may practically be employed.

Moreover, such reinforcement can be applied in a manner which is both simple and inexpensive, and which is conducive to fast, high-volume production of composite packages.

In a possible variant, the grip portion is at least partially constituted by a portion of the sheet of cardboard that is folded into a substantially prismatic form.

This is advantageous in that the grip portion is provided with a form that spreads the weight of the composite package over the user's hand more evenly, and is thus more comfortable to carry. The maximum weight of the composite package may thereby be increased, broadening the range of application of the handle.

Preferably, the grip portion has a substantially triangular cross-section.

This is advantageous in that a substantially triangular cross-section will maximize the strength and durability of the grip portion while incurring a minimal increase in its weight and complexity of fabrication.

In another possible embodiment, the handle comprises loop of a flexible band, said loop of flexible band comprising a root portion, at least part of said root portion being disposed about at least one of the primary packages within the secondary package; and a grip portion at least partially constituted by a region of the flexible band that is disposed outside said secondary package when said handle is in the extracted position.

This is advantageous in that, as the root portion extends into the secondary package and about at least one of the primary packages, the root portion is securely anchored within the secondary package. A composite package so configured may therefore be configured to carry a greater weight in product than the packages known in the prior art.

In addition, the provision of the handle as so configured will increase the comfort with which the user can carry the composite package.

Preferably, the grip portion further comprises a pliable element, attached to the flexible band and configured to be wrapped or folded about said flexible band.

This is advantageous in that the pliable element provides a comfortable grip for the user's hand, in a form which is very simply, easily, and inexpensively provided.

When folded about the flexible band, the padding element gives an additional degree of comfort to the user when transporting the composite package, particularly when the primary packages hold cumbersome, heavy, and/or dense substances such as water.

Most preferably, the pliable element is a substantially rectangular sheet comprising paper, cardboard, or foam.

Such a padding element is advantageous in that it is simple and inexpensive to provide and attach to the flexible band, while still realizing a satisfactory improvement in comfort in most applications.

Preferably, the loop of the flexible band is split over a portion of its length into a plurality of branches each disposed about at least one of the primary packages within the secondary package.

This advantageous in that the load of the primary packages is more evenly distributed upon the loop of flexible band. The composite package is thereby made more balanced and more resistant to breakage while being carried.

In a third possible embodiment, the composite package comprises a plurality of secondary packages, and the handle comprises a grip portion; a root portion extending from said grip portion at one extremity and separating into a plurality of branches at another extremity; and a plurality of anchor portions, each of said anchor portions extending from a branch of said root portion and being attached to the envelope disposed about one of said secondary packages.

This is advantageous in that, as each anchor portion is attached to the envelope of a secondary package, the handle may be attached and the composite package assembled with a maximum of speed and efficiency.

In a possible variant, said grip portion is at least partially constituted by a region of the root portion.

This is advantageous in that the overall weight and complexity of the handle is minimized.

In another possible variant, said grip portion further comprises a resilient plate, the root portion being disposed about and laminated to said resilient plate.

This is advantageous in that the provision of a resilient plate will render the handle more comfortable during use, as it serves to spread the weight of the composite package over a greater area of the user's hand. Moreover, the lamination of the flexible portion to the resilient plate increases the strength of the handle, helping avoid inadvertent tears or breakages of the handle during use.

In a practical embodiment, the primary packages are plastic bottles.

In such an embodiment the present invention is particularly advantageous in that plastic bottles, being roughly cylindrical in form, are readily gathered into secondary packages, with a certain amount of interstitial space left between them to permit the installation of a handle according to the present invention. Moreover, plastic bottles are commonly filled with heavy, dense, and/or cumbersome contents, applications for which a composite package according to the present invention is well-suited.

In another practical embodiment, the primary packages contain water.

In such an embodiment the present invention is particularly advantageous, in that water is a product that is often purchased in large quantities in the form of secondary packages such as described above, which are often very heavy and cumbersome as a result. The advantages of the present invention are therefore particularly appealing when applied to water.

BRIEF DESCRIPTION OF THE DRAWINGS

Additional features and advantages of the present invention are described in, and will be apparent from, the description of the presently preferred embodiments which are set out below with reference to the drawings in which.

DETAILED DESCRIPTION OF THE INVENTION

For a complete understanding of the present invention and the advantages thereof, reference is made to the following detailed description of the invention.

It should be appreciated that various embodiments of the present invention can be combined with other embodiments of the invention and are merely illustrative of specific ways to make and use the invention and do not limit the scope of the invention when taken into consideration with the claims and the following detailed description.

As used in this specification, the words "comprises," "comprising," and similar words, are not to be interpreted in an inclusive or exhaustive sense. In other words, they are intended to mean "including, but not limited to."

Furthermore, in the following description, it should be understood that terms used to express geometric or other such relations (e.g. "parallel") between components are considered as being substantive terms rather than exact ones, and that as a result the qualifier "substantially" is to be read into any such term unless stated otherwise.

The invention is further described with reference to the following examples. It will be appreciated that the invention as claimed is not intended to be limited in any way by these examples.

Figure 1:
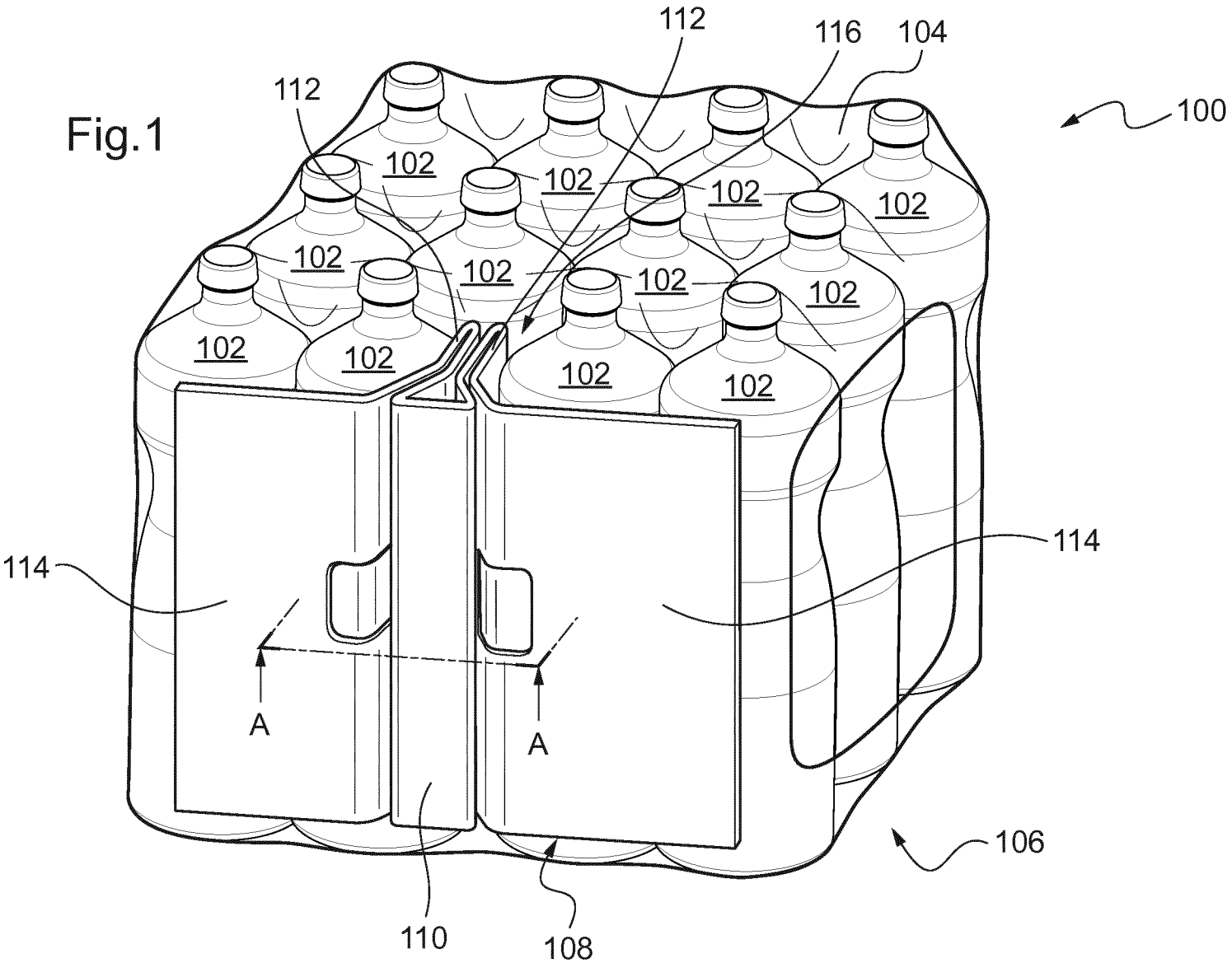
FIG. 1 is a perspective view of a composite package according to a first embodiment of the invention.

In FIG. 1 there is depicted a composite package 100. The composite package 100 comprises a plurality of primary packages 102. The primary packages 102 are grouped together; in this embodiment there is thus formed an array of primary packages 102 four containers wide by three containers deep.

The primary packages 102 are, here, plastic bottles containing water. Secondary packages comprising plastic bottles of water are the most common manifestations of the multi-pack principle; however, it will be well understood that composite packages according to the present invention, comprising other primary package formats and containing other types of products, may be readily constituted according to the principles of the present invention.

In the present embodiment, the primary packages 102 are identical, being of equal size and containing equal volumes of product therein. However, in other embodiments it may be preferable for one reason or another to provide primary packages in different volumes. It should be understood that the person of skill in the art will be readily able to determine the arrangement for grouping the primary packages which is most appropriate for the particular application in question.

The composite package 100 further comprises an envelope 104 which is disposed about the primary packages 102 so as to bind them together. The envelope 104 is preferably fabricated from a heat-shrinking plastic film, though other means for forming the envelope could conceivably be used.

The combination of the grouped primary packages 102 and the envelope 104 constitutes a secondary package 106. The secondary package 106, by virtue of the compression exerted upon the primary packages 102, and by the rigidity offered by the primary packages 102 themselves, forms a single, cohesive unit. The composite package 100 of this embodiment thus comprises a single secondary package 106, though in other embodiments more than one secondary package may be included.

The composite package 100 further comprises a handle 108, comprising a grip portion 110, two flexible portions 112, and two anchor portions 114. In this embodiment, the handle 108 is provided as a flat sheet of material which is folded in several places, thereby reducing the cost and complexity of its construction; other configurations may be preferable depending on the particular application in question.

The composite package 100 is notable in that the handle 108 is partially disposed within an interstice 116 which is formed between two of the containers 102 within the secondary package 106. The handle 108 is thus implemented with a minimal increase in the overall size of the composite package 100 relative to the secondary package 106, in that the projecting parts of the grip portion 110 and the flexible portions 112 are disposed within the secondary package 106 among the containers 102, while the anchor portions 114 of the handle 108 lie flat against one side of the secondary package 106.

Figure 2B:
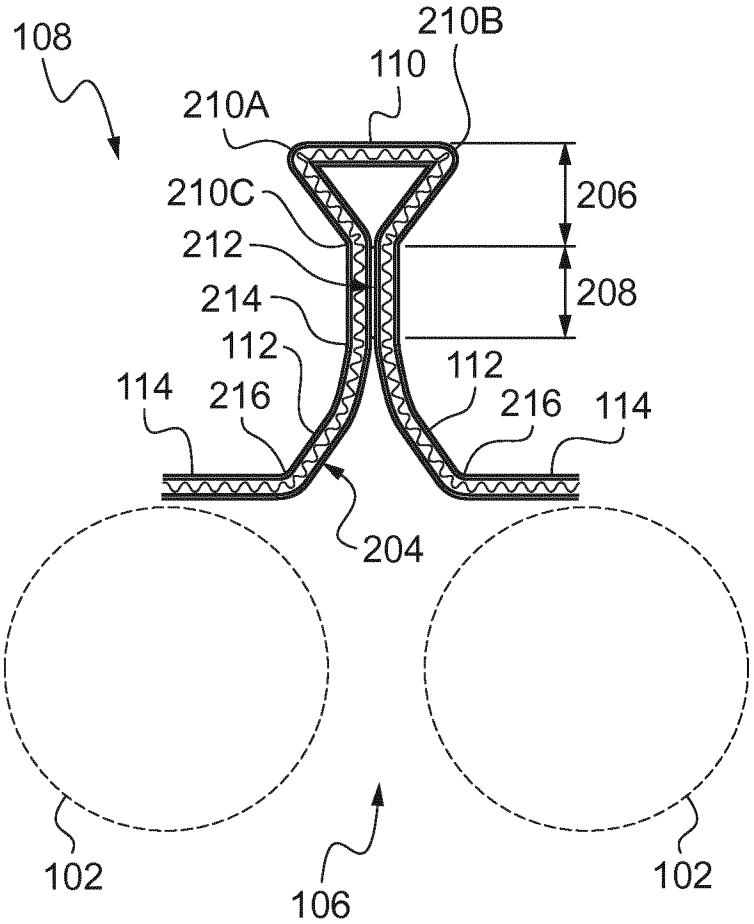
FIGS. 2A & 2B are cross-sectional views of a handle of the composite package of FIG. 1, disposed in a retracted first and extracted second position, respectively.
Figure 2A:
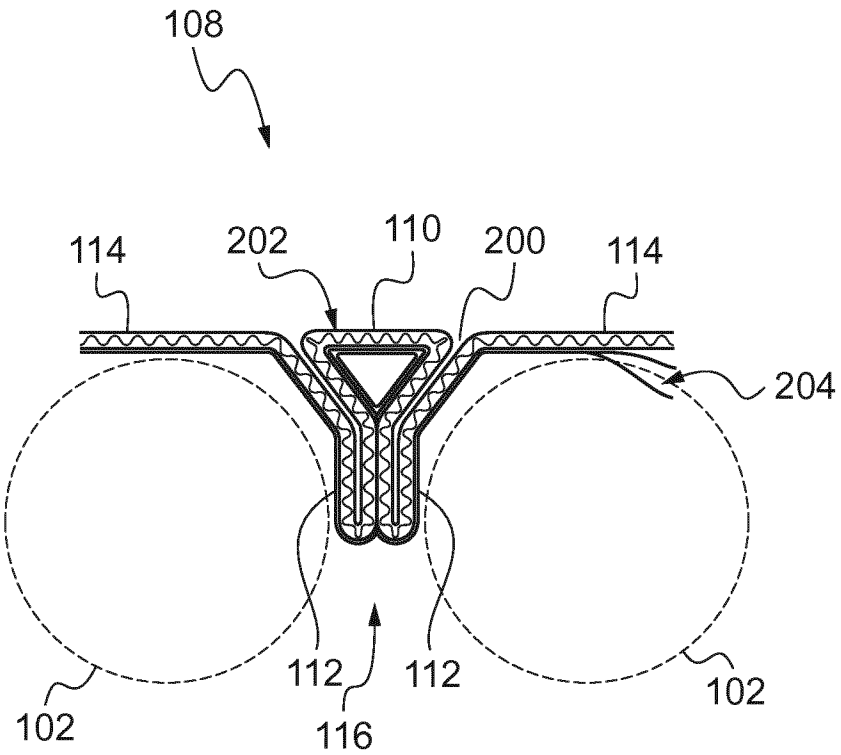

In FIG. 2A, the handle 108 is depicted in the retracted first position. The handle 108 comprises the grip portion 110, the two flexible portions 112, and the two anchor portions 114. The handle 108 is depicted positioned relative to two of the primary packages 102, within the interstice 116 formed therebetween.

The flexible portions 112 extend from the anchor portions 114 so as to form a recess 200. The grip portion 110 is accommodated within the recess 200 as shown when the handle 108 is in the retracted first position, said recess 200 thus extending between the two primary packages 102.

In this embodiment, this has the effect of putting a distal surface 202 of the grip portion 110 substantially flush with the anchor portions 114; in other embodiments the relative positions of the grip portion 110 and anchor portions 114 will depend on their dimensions and on the dimensions of the flexible portions 112, and the person of skill in the art will be able to determine the proper configuration for any particular implementation.

The handle 108 is preferably fabricated from a sheet of cardboard, as shown here, since cardboard is inexpensive, readily available, strong, and can be treated with any number of reinforcement coatings, films, impregnants or the like to realize desired properties that may not be present in untreated cardboard stock, such as improved tensile strength, fatigue resistance, or water-resistance.

In this embodiment, the handle 108 is fabricated from two-ply corrugated cardboard, to which a reinforcement band 204 is laminated. The reinforcement band 204 is simply a plastic member which is laminated to the cardboard stock of the handle 108 over both anchor portions 114, both flexible portions 112, and the grip portion 110, so as to improve both the strength of the handle 108 and its fatigue and wear resistance. The handle 108 may thereby carry more weight and better resist fraying and tearing due to repeated flexion.

Of course, it will be readily understood that other materials may be employed to fabricate the handle, such as smooth or corrugated plastic, fabric, felted fiber, etc, and may be chosen by one skilled in the art as most appropriate for the implementation in question.

FIG. 2B depicts the handle 108 disposed in the extracted second position. The grip portion 110 has been displaced such that it now projects outwardly from the primary packages 102, and thus may now be grasped by the user.

In this embodiment, the grip portion 110 comprises two component regions: the prismatic region 206, and the stem region 208. The prismatic region 206 comprises a portion of the handle 108 wherein the sheet of cardboard is folded into a triangular prism comprising three vertices 210A, 210B, and 210C. In this way, the grip portion 110 is given a certain amount of volume, making it fall more comfortably to hand.

Of course, other prismatic forms may be employed, or the prismatic form may be dispensed with entirely, according to the needs of the particular application in question.

From the vertex 210C of the prismatic region 206 extends the stem region 208, here comprised by two thicknesses of the sheet of cardboard. The stem region 208 is preferably given a certain degree of rigidity; in this embodiment, the presence of two plies of the reinforcement band 204, two plies of the sheet of cardboard, and of a layer of glue 212 laminating them together, serve to rigidify the stem region 208.

The flexible portions 112 form a continuation of the grip portion 110 at the stem region 208, extending from the extremity 214 of the stem portion 208; likewise, the anchor portions 114 are themselves continuations of their respective flexible portions 112, extending from the extremities 216 thereof. The extremities 214, 216 can thus be regarded as delimiting the flexion of the flexible portions 112.

Indeed, relative to the flexible portions 112, the grip portion 110 is given a high degree of rigidity, facilitating its extraction from and retraction into the secondary package 106. This makes the composite package in which the handle 108 is incorporated easier to use, particularly where it can be expected that the handle 108 will pass between the extracted and retracted positions several times before the composite package is opened up.

Figure 3B:
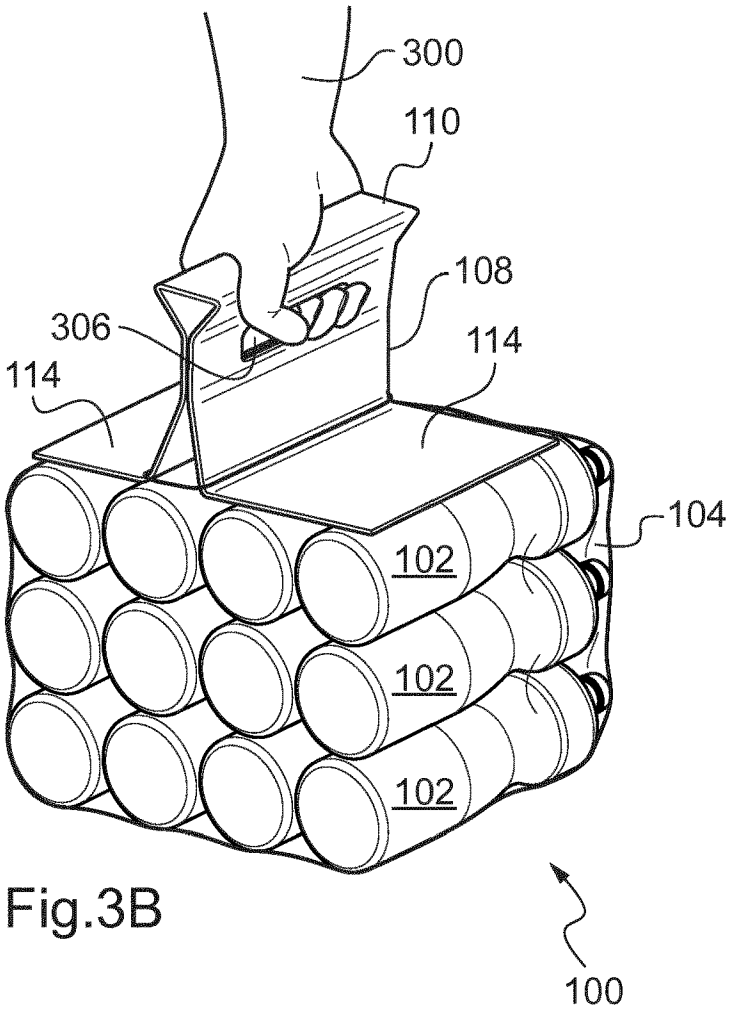
FIGS. 3A & 3B are perspective views of the composite package of FIG. 1, depicting the handle in a retracted first position and an extracted second position, respectively.
Figure 3A:
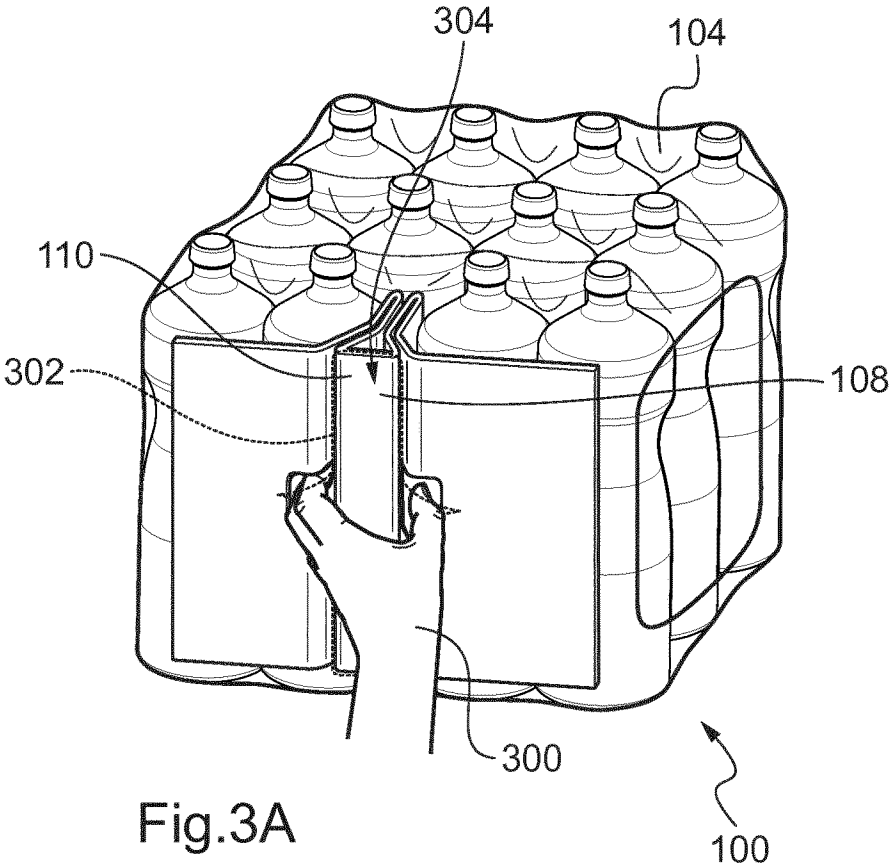

FIGS. 3A & 3B further illustrate the usage of the handle 108 of the composite package 100. In FIG. 3A, the user's hand 300 has seized the grip portion 110 of the handle 108, and is about to extract it from the composite package 100.

To do this, the user first breaks a perforation 302 provided in the envelope 104. The perforation 302 defines a region 304 of the envelope 104 which roughly corresponds to the grip portion 110 of the handle 108. The user may remove the entire region 304, or may simply insert his/her fingers through the perforation 302 and grasp the grip portion 110; the rest of the perforation 302 will break as the handle 108 is extracted.

FIG. 3B depicts the composite package 100 with the handle 108 in the extracted second position. The grip portion 110 in this embodiment is furnished with a cut-out 306 which allows the user to wrap his hand 300 fully around the grip portion 110, further improving comfort and usability.

The composite package 104 is held together by the envelope 104, which retains the primary packages 102 in arrangement and transfers their weight to the anchor portions 114 of the handle 108.

Figure 4B:
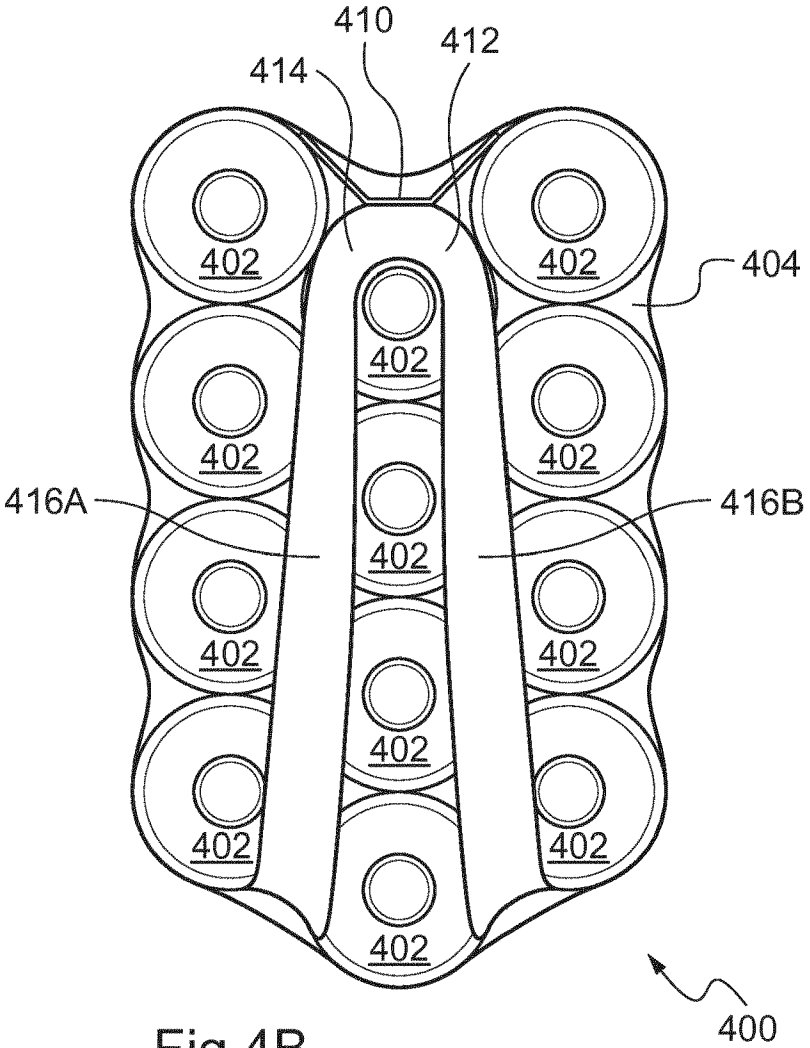
FIGS. 4A & 4B are perspective and side views, respectively, of a package according to a second embodiment, with a handle disposed in a retracted first position.
Figure 4A:
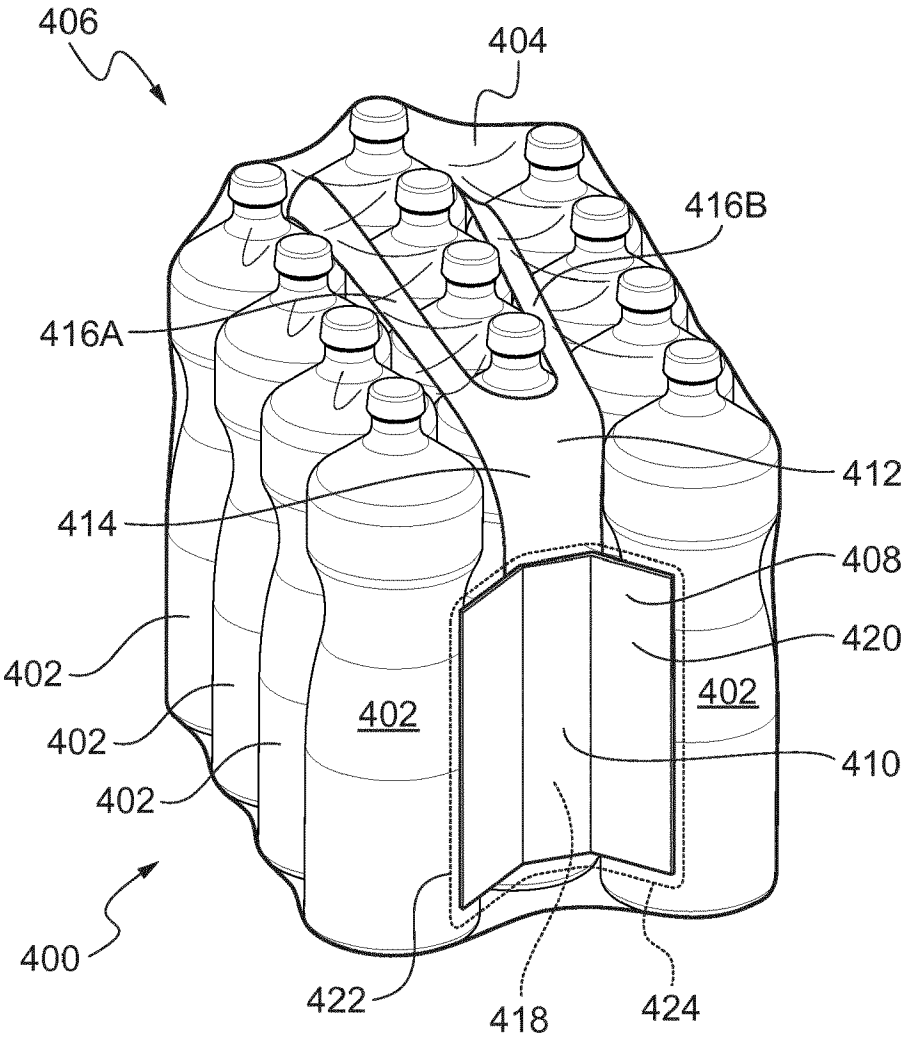

In FIG. 4A, a composite package 400 is, as in the embodiment depicted in the preceding Figures, comprised of a plurality of primary packages 402 (of which only a portion are numbered here, for clarity), gathered together and enclosed by an envelope 404. The envelope 404 binds the primary packages 402 together so as to comprise the secondary package 406.

The composite package 400 further comprises a handle 408. The handle 408 comprises a loop of a flexible band 410 which is disposed at least partially within the secondary package 406 and comprises a root portion 412 and a grip portion 414.

The root portion 412 is constituted by the portion of the flexible band 410 which is disposed substantially within the secondary package 406 and which extends about the primary packages 402, so as to form a "cradle" or "sling" which supports the weight of said primary packages 402.

In this embodiment, the flexible band 410 of the root portion 412 is partially divided so as to form two separate branches 416A and 416B. The presence of the two branches 416A, 416B results in a better partition of the weight of the primary packages 402 within the composite package 400, making the composite package 400 stronger and easier to carry.

The grip portion 414 is partially constituted by a region 418 of the flexible band 410. The region 418 of the flexible band 410 is configured to be disposed outside the composite package 400 when the handle 408 is disposed in the extracted second position; thus, it may be simply a portion of the flexible band 410 that is intended to be grasped by the user or, as in the present embodiment, it may comprise other structure as necessary to the embodiment.

In the present embodiment, the grip portion 414 further comprises a pliable element 420. The pliable element 420 is here laminated to the region 418 of the flexible band 410. The pliable element 420 may further be attached to the envelope 404 over the region 422 of the envelope 404, which is delimited by the perforation 424. The perforation 424 serves to permit easy access by the user to the handle 408; this is discussed in further detail below with relation to FIG. 5.

The pliable element 420 is, as seen here, a substantially flat sheet of material, preferably of paper, cardboard, or foam. The pliable element 420 is configured to be folded or wrapped about the flexible band 410, thereby increasing the thickness of the grip portion 414 where said pliable element 420 is disposed; this will be discussed in greater detail below with reference to FIG. 5.

FIG. 4B depicts the composite package 400 from a side, illustrating how the two branches 416A, 416B of the flexible band 410 are disposed about the primary packages 402. The two branches 416A, 416B each extend away from the grip portion 414, such that they are disposed about the three primary packages 402 that are most distally located from said grip portion 414. The two branches 416A, 416B work in concert with the envelope 404 to maintain the composite package 400 and carry the weight of the primary packages 402.

FIG. 4B further illustrates how the root portion 412 of the loop of flexible band 410 may be disposed within the secondary package 406. Specifically, the primary packages 402 are disposed in a staggered arrangement, rather than in a simple square arrangement as in the embodiment depicted in FIGS. 1 to 3B.

The disposition of the round primary packages 402 in an array will form recesses between them, into which the root portion 412 and the grip portion 414 are disposed as seen here, thereby protected by the primary containers 402. This staggered arrangement also reduces the overall size of the composite package 400 by minimizing the size of the spaces between the primary packages.

It should also be recognized that a certain amount of slack is provided in the flexible band 410, to permit the handle 408 to be extracted from the composite package 400. As the handle 408 is extracted from the composite package 400, the branches 416A, 416B of the flexible band 410 will cinch about the primary packages 402, permitting the user to lift and carry the composite package 400.

Figure 5:
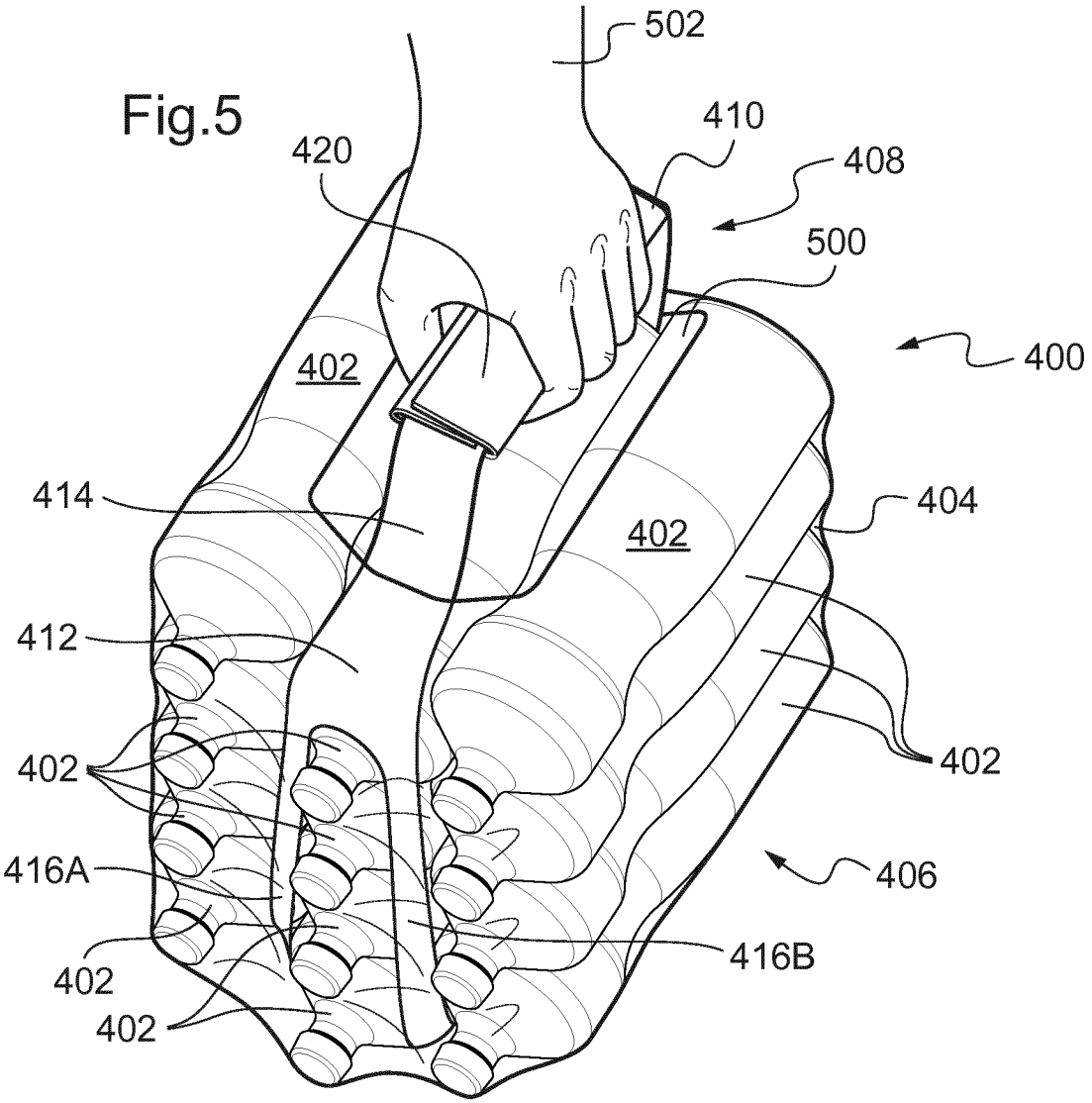
FIG. 5 is a perspective view of the package of FIG. 4 with the handle disposed in an extracted second position.

FIG. 5 depicts the composite package 400 with the handle 408 disposed in the extracted second position. The handle 408 is fully extracted from the secondary package 406, such that a portion of the flexible band 410 comprising the grip portion 414 projects through a window 500 in the envelope 404. The window 500 is formed by the detachment of the region of the envelope delimited by the perforation (not shown), which is described above in relation to FIG. 4A.

The pliable element 420 is here wrapped about the flexible band 410, padding the grip portion 414 and offering a more comfortable feel for the hand 502 of the user.

Moreover, in the same way as FIG. 4B, it can be seen that the two branches 416A, 416B of the flexible band 410 in the root portion 412 are pulled taut about the primary packages 402 by the weight of the latter. The flexible band 410, in concert with the envelope 404, thus permits the composite package 400 to be lifted and carried about by the handle 408.

Figure 6:
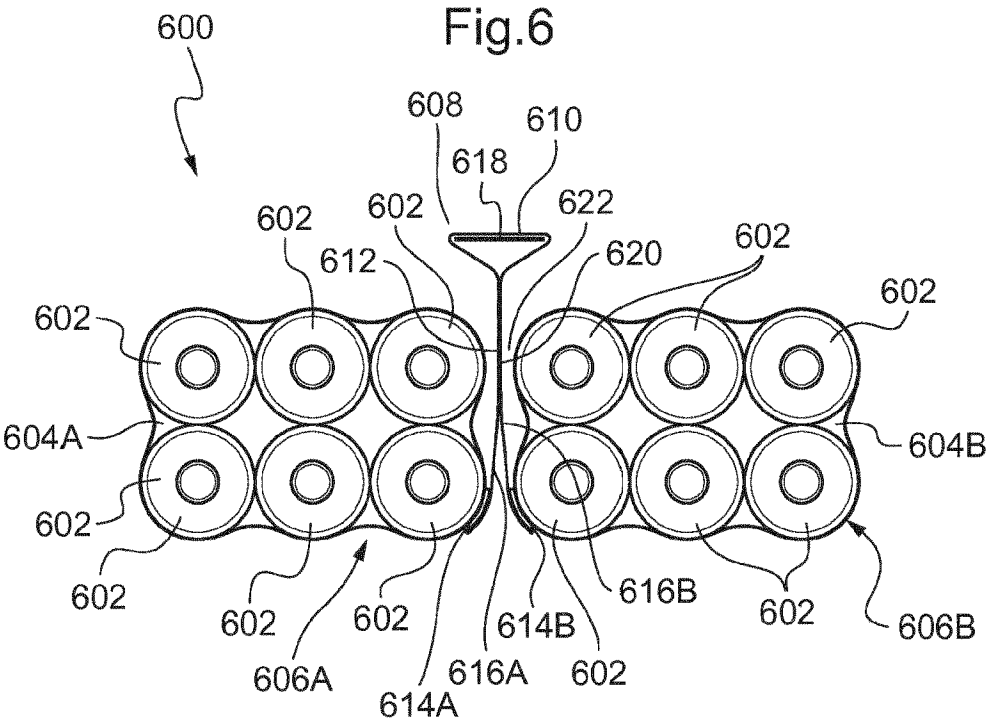
FIG. 6 is a side view of a package according to a third embodiment, with a handle disposed in a retracted first position.

In FIG. 6, there is depicted a composite package 600 which, as with the previous embodiments, comprises a plurality of primary packages 602. The primary packages 602 are separated into two groups, each of which is covered with an envelope 604A, 604B to form two secondary packages 606A & 606B.

Here, the two secondary packages 606A, 606B are essentially identical, being both constituted of an equal number of identical primary packages 602 and enclosed by an envelope 604A, 604B; it will thus be understood that the secondary packages may be advantageously fabricated in a process separate from the manufacturing of the composite package 600. Such an arrangement will advantageously lend a degree of modularity to the fabrication of composite packages.

Moreover, while in the present embodiment only two secondary packages 606A, 606B are utilized to fabricate the composite package 600, in other embodiments it may be advantageous to furnish three or more secondary packages, depending on the particularities of the application in question.

The composite package 600 comprises, in addition to the two secondary packages 606A and 606B, a handle 608. The handle 608 is comprised of a grip portion 610, a root portion 612, and anchor portions 614A, 614B. As can be seen in FIG. 6, the root portion 612 bifurcates into two branches 616A, 616B, each of which terminates at the anchor portions 614A, 614B, respectively. The anchor portions 614A, 614B are each attached to the envelope of one of the secondary packages 606A, 606B.

The root portion 612 is, in this embodiment, comprised of a piece of plastic sheet which is wrapped about a resilient plate 618; the part of the root portion 612 that is disposed about the resilient plate 618 thus partly constitutes the grip portion 610. The plastic sheet continues from the resilient plate 618, and is laminated to itself at the stem 620, then splits into the branches 616A, 616B as described above. Said lamination gives the handle 608 additional durability and rigidity.

Of course, in alternate embodiments it may be that the grip portion is constituted merely by a region of the root portion which is intended to be grasped, with or without lamination over a stem portion. The exact configuration will depend on the particularities of the application in which it is to be employed.

The resilient 618 plate may be provided in any material which is reasonably stiff yet not overly so, as it constitutes a part of the grip portion 610 and will be thus grasped by the hand of a user when the composite package 600 is lifted. Ideally, the resilient plate 618 is fabricated from paper, cardboard, or foam, though other materials could conceivably be used.

It should be noted that under ordinary conditions, when the handle 608 is disposed in the retracted first position, it will be substantially lodged within the interstice 622, with the secondary packages 606A, 606B being tight against each other and the grip portion 610 being either lodged within the interstice 622 or lying flush against the envelopes 604A, 604B of the secondary packages 606A, 606B. FIG. 6 depicts these components as separated for illustrative purposes only, and should not be construed as limiting in this sense.

Figure 7:
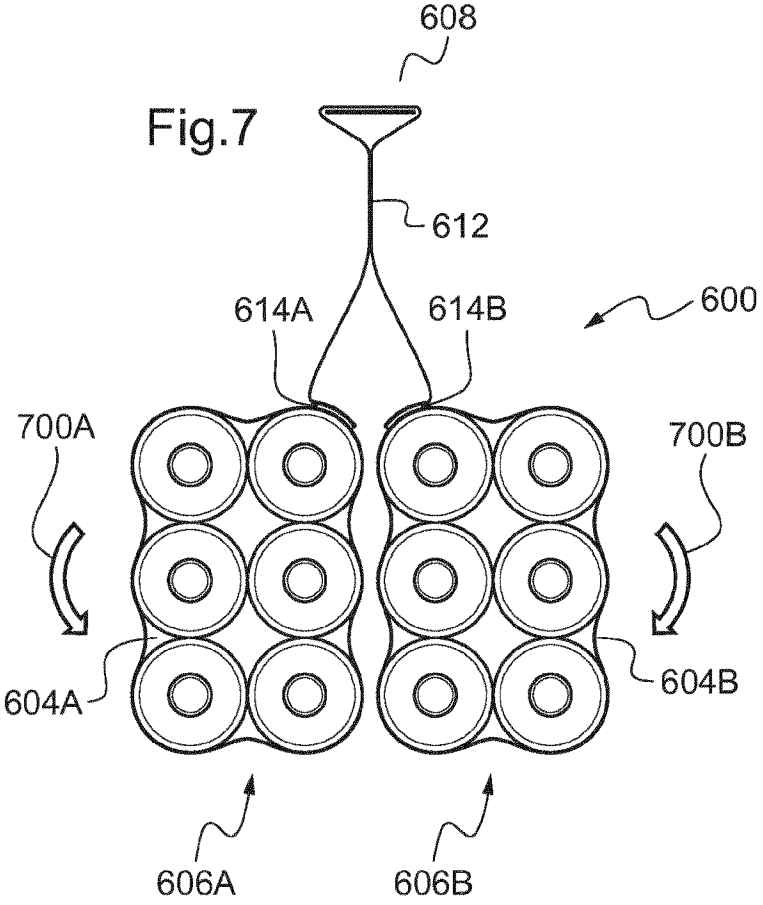
FIG. 7 is a side view of the package of FIG. 6 with the handle disposed in an extracted second position.

FIG. 7 depicts the composite package 600 with the handle 608 disposed in the extracted second position. When the handle 608 is grasped and extracted from the composite package 600 by the user, it will pull on the root portion 612 and the anchor portions 614A, 614B and cause the secondary packages 606A, 606B to rotate in directions 700A and 70013, respectively. The secondary packages 606A, 606B can then be transported, as the anchor portions 614A, 614B hold each of the secondary packages 606A, 606B to the root portion 612.

It will be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

The invention claimed is:

1. A composite package comprising a plurality of primary packages, the plurality of primary packages being gathered into at least one secondary package comprising an envelope surrounding at least some of the plurality of primary packages, the composite package comprising a handle for manipulating the at least one secondary package, the handle comprises a grip portion, two anchor portions, and two stem regions connecting the grip portion to the two anchor portions, the handle being between a retracted first position wherein the two stem regions of the handle are located between two or more of the plurality of primary packages, and an extracted second position wherein the two stem regions of the handle project at least partially from the at least one secondary package.

2. The composite package according to claim 1, wherein the handle is located within the envelope of the at least one secondary package when in the retracted first position, and wherein the envelope is perforated so as to at least partially delimit a region of the envelope coincident with the handle.

3. The composite package according to claim 1, wherein the composite package comprises a single secondary package.

4. A composite package comprising a plurality of primary packages, the plurality of primary packages being gathered into a single secondary package comprising an envelope surrounding at least some of the plurality of primary packages, the composite package comprising a handle for manipulating the single secondary package, the handle is mobile between a retracted first position wherein two stem regions of the handle are located between two or more of the plurality of primary packages, and an extracted second position wherein the two stem regions of the handle project at least partially from the single secondary package;

wherein the handle comprises:

a grip portion;

two flexible portions each extending from an extremity of the grip portion; two anchor portions each extending from an extremity of a flexible portion opposite the grip portion and embedded within the composite package; and the two stem regions connecting the grip portion to the two anchor portions;

such that when the handle is in the retracted first position, the two flexible portions are folded to form a recess within the single secondary package in which the grip portion is substantially enclosed between the two anchor portions, and when the handle is in the extracted second position, the grip portion is outside of the recess and the two anchor portions.

5. The composite package according to claim 4, wherein the recess extends between two of the plurality of primary packages.

6. The composite package according to claim 4, wherein the handle is at least partially constituted by a sheet of cardboard.

7. The composite package according to claim 6, wherein the grip portion comprises a lamination of at least two thicknesses of the sheet of cardboard.

8. The composite package according to claim 6, wherein the handle is at least partially reinforced by a reinforcement comprising a band or film laminated with the sheet of cardboard, or a coating or impregnant applied to the sheet of cardboard.

9. The composite package according to claim 6, wherein the grip portion is at least partially constituted by a portion of the sheet of cardboard that is folded into a substantially prismatic form.

10. The composite package according to claim 9, wherein the grip portion comprises a substantially triangular cross-section.

11. The composite package according to claim 1, wherein the plurality of primary packages are plastic bottles.

12. The composite package according to claim 1, wherein the plurality of primary packages contain water.

* * * * *